US006393987B1

(12) United States Patent
Bolza-Schünemann et al.

(10) Patent No.: US 6,393,987 B1
(45) Date of Patent: May 28, 2002

(54) METHOD AND DEVICE FOR DRIVING A PRINTING PRESS WITH AN INTEGRATED IMAGING DEVICE

(75) Inventors: Hans-Bernhard Bolza-Schünemann, Würzburg; Victor Hefftler, Coswig; Reinhard Nerger, Radebeul; Arndt Jentzsch, Coswig; Michael Pscheidl, Heidenau; Michael Kastner, Cossebaude, all of (DE)

(73) Assignee: Koenig & Bauer AG (DE)

( * ) Notice: Subject to any disclaimer, the term of this patent is extended or adjusted under 35 U.S.C. 154(b) by 0 days.

(21) Appl. No.: 09/450,630

(22) Filed: Nov. 22, 1999

Related U.S. Application Data

(63) Continuation of application No. PCT/DE98/01528, filed on Jun. 2, 1998.

(30) Foreign Application Priority Data

| | | |
|---|---|---|
| Jun. 3, 1997 | (DE) | 197 23 147 |
| Oct. 31, 1997 | (DE) | 197 48 119 |
| Feb. 20, 1998 | (DE) | 198 07 127 |

(51) Int. Cl.[7] ..... B41F 7/02; B41N 1/14

(52) U.S. Cl. ..... 101/483; 101/142; 101/217; 101/467

(58) Field of Search ..... 101/401.1, 467, 101/216, 217, 141, 142, 177, 232, 483

(56) References Cited

U.S. PATENT DOCUMENTS

| | | | | |
|---|---|---|---|---|
| 3,167,007 A | | 1/1965 | Klauss et al. | |
| 4,911,075 A | * | 3/1990 | Lewis et al. | 101/483 |
| 4,936,211 A | * | 6/1990 | Pewsavecchia et al. | 101/467 |
| 5,163,368 A | * | 11/1992 | Pewsavecchia et al. | 101/467 |
| 5,713,287 A | * | 2/1998 | Gelbart | 101/467 |
| 6,101,944 A | * | 8/2000 | Schmid et al. | 101/467 |

FOREIGN PATENT DOCUMENTS

| | | |
|---|---|---|
| DE | 1 168 449 | 4/1964 |
| DE | 33 44 131 | 6/1985 |
| DE | 19515077 | 10/1988 |
| DE | 195 15 077 | 10/1996 |
| DE | 196 12 927 | 11/1996 |
| EP | 0 047 165 | 3/1982 |

* cited by examiner

*Primary Examiner*—Eugene Eickholt
(74) *Attorney, Agent, or Firm*—Goodwin Procter LLP

(57) ABSTRACT

A method for driving a printing press having, (i) an impression cylinder, (ii) at least one cylinder group having (a) a blanket cylinder, (b) a printing form cylinder, and (1) an imaging device, (2) an inking unit, and (3) an inherent drive system, all for said printing form cylinder, (iii) a sheet feeding device, (iv) a sheet delivering device, (v) a drive wheel train connecting the cylinders and the inking unit, and (vi) optionally a main motor drive, the method comprising detaching the printing form cylinder from the drive wheel train, driving the printing form cylinder by the inherent drive system at imaging speed during image formation, and re-attaching the printing form cylinder after image formation to the drive wheel train in an operating phase position.

15 Claims, 7 Drawing Sheets

METHOD AND DEVICE FOR DRIVING A PRINTING PRESS WITH AN INTEGRATED IMAGING DEVICE

This is a continuation of international application No. PCT/DE98/01528, filed on Jun. 2, 1998.

FIELD OF INVENTION

The invention relates to a method and device for driving a printing press with an integrated imaging device.

BACKGROUND OF INVENTION

A printing press with an impression cylinder, a blanket cylinder, a printing form cylinder, an inking unit and imaging device allocated to the printing form cylinder is known from e.g. German patent No. 195 15 077 A1. These elements are connected with each other by a gear train. The inking unit can be detached from the gear train for the image formation on the printing form cylinder.

A disadvantage of this procedure is that the image formation takes a longer time because the imaging speed, i.e. the rotating speed of the printing form cylinder during the image formation, is identical with the maximum printing speed.

BRIEF DESCRIPTION OF INVENTION

It is an object of the present invention to provide a method and a device enabling higher imaging speed and therefore minimizing the time required for image formation. Accordingly, the present invention provides a method and a device enabling a high imaging speed and minimizing the image formation time.

According the present invention the printing form cylinder drive is detached from the drive wheel train, and the printing form cylinder is driven by a dedicated drive at imaging speed during image formation and the printing form cylinder is attached to the drive wheel train in the operating phase position. Thus the present invention provides a method for driving a printing press having (i) an impression cylinder, (ii) at least two cylinder groups each having (a) a blanket cylinder, (b) a printing form cylinder, and (1) an imaging device, (2) an inking unit, and (3) and dedicated drive, all for said printing form cylinder, (iii) a sheet feeding device, (v) a drive wheel train connecting said cylinders and said inking unit, and (vi) a main motor drive, the method comprising detaching the printing form cylinder from said drive wheel train, driving said printing form cylinder by said dedicated drive at imaging speed during image formation, and re-attaching said printing form cylinder after image formation to said drive wheel train in an operating phase position.

As used throughout the disclosure and the claims, any reference to a "dedicated drive" means a separate, own drive for a cylinder having such a dedicated drive.

BRIEF DESCRIPTION OF THE DRAWING

The invention is described below in greater detail by an embodiment of the invention, with reference being had to the drawing, wherein.

DETAILED DESCRIPTION

Figure 1:
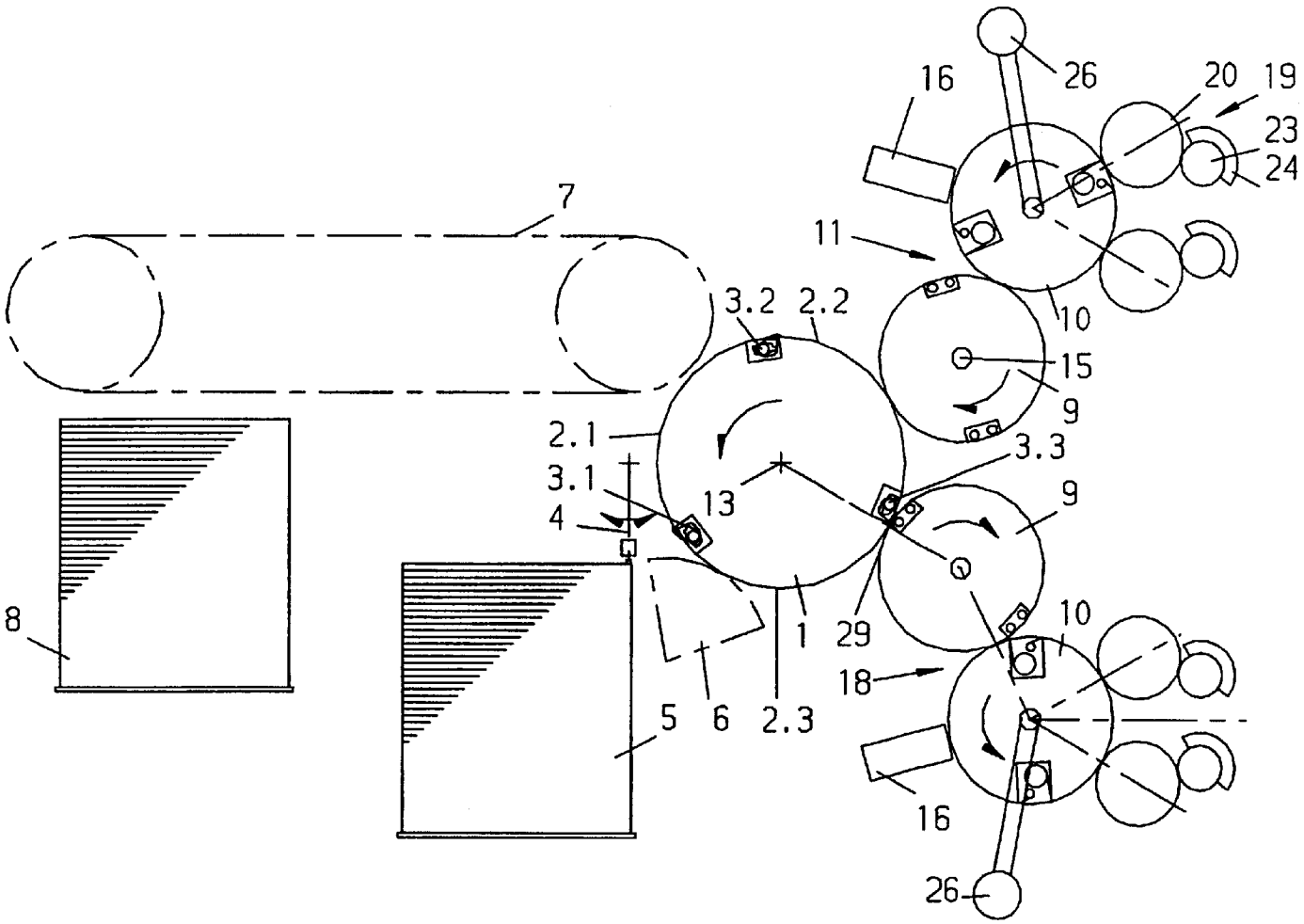
FIG. 1 is a schematic representation of a printing press.

A four color printing press is shown in FIG. 1. The press has an impression cylinder 1 with three printing areas 2, respectively designated as 2.1, 2.2, and 2.3, and with three gripper rows 3, respectively designated as 3.1, 3.2, and 3.3. A sheet feeding unit having a front edge sheet separator 4 and a gripper system 6 for transporting one sheet at a time to be printed from a feeder pile 5 to the impression cylinder 1 precedes the impression cylinder 1. Sheet feeding to the impression cylinder 1 is arranged so that only every second gripper row 3 of the impression cylinder 1 receives a sheet. A delivery chain system 7 is allocated to the impression cylinder for sheet delivery. It takes the printed sheet from the impression cylinder 1 and transports it to a delivery pile 8. Also in this case only every second gripper row of the impression cylinder 1 delivers a sheet.

Two cylinder groups 11, 18 are allocated to the impression cylinder 1. Each cylinder group has one blanket cylinder 9 with two operating surfaces in operating connection with the impression cylinder 1 and a printing form cylinder 10 with two operating surfaces in operating connection to the blanket cylinder. The cylinders, i.e. impression cylinder 1, blanket cylinder 9 and printing form cylinder 10, are shown in their proper operating phase positions, in which the contact points of the corresponding opposite cylinders the operating surfaces facing each other with the front line of printing 29. In this operating phase position the drive wheel train connects the cylinders with each other. The front lines of printing 29 of the cylinders, i.e. impression cylinder 1 and blanket cylinder 9 of the second cylinder group 18 are facing each other as shown in FIG. 1.

An inking unit 19 is assigned to each operating surface of each printing form cylinder 10. The inking unit 19 contains a form roller 20. The inking unit 19 in the embodiment shown in FIG. 1 is configured as an Anilox inking unit. The Anilox inking unit contains besides the form roller 20 an ink metering roller 23 and a doctor blade system 24 therefor.

The printing press shown in FIG. 1 is equipped with two cylinder groups 11, 18, with two blanket cylinders each with two operating surfaces, two printing form cylinders each with two operating surfaces, and four inking units, and therefore can operate as a four-color-press.

A printing press equipped with two blanket cylinders each having one operating surface, two printing form cylinders each having one operating surface, and two inking units, can operate as a two-color-press.

A printing press equipped with only one blanket cylinder and one printing form cylinder can operate as a one-color- or a two-color-press.

Figure 2:
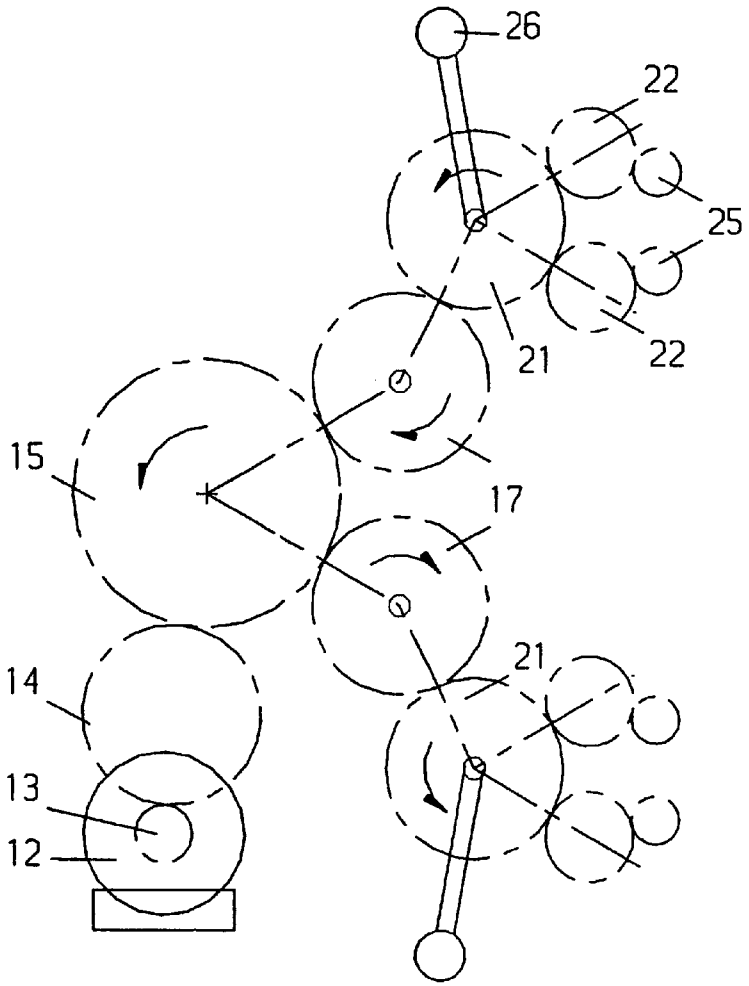
FIG. 2 is an arrangement of the drive wheel train.

FIG. 2 shows the drive wheel train of a four-color-version of a printing press, with two cylinder groups. The drive wheel train has a motor 12 with a motor pinion 13, an intermediate wheel 14, an impression cylinder drive wheel 15, two blanket cylinder drive wheels 17, two printing form cylinder drive wheels 21, four form roller drive wheels 22 and four ink metering roller drive wheels 25. An dedicated drive 26 is allocated to each printing form cylinder.

Figure 3:
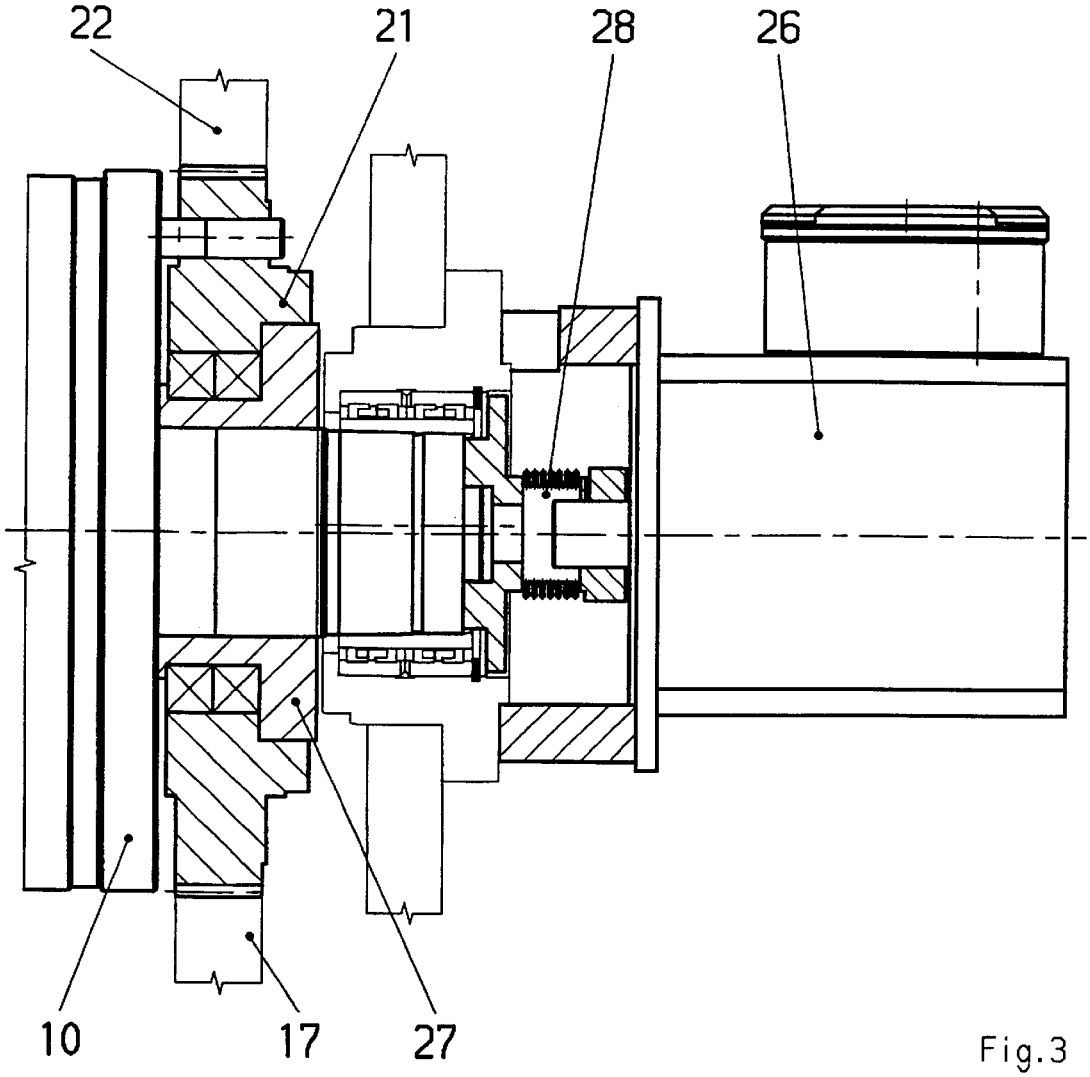
FIG. 3 is a printing form cylinder.

The allocation of the dedicated drive 26 and the arrangement of the printing form cylinder drive wheel 21 at the printing form cylinder 10 are shown in FIG. 3. The printing form cylinder 10 is connected with the printing form cylinder drive wheel 21 through a phase position clutch 27. The printing form cylinder drive wheel 21 is part of the gear train of the printing press and is meshing with the blanket cylinder drive wheel 17 and with the form roller drive wheel 22. The printing form cylinder 10 is suitably connected from its dedicated drive 26 through a metal bellows clutch 28. The dedicated drive 26 is suitably an electric motor.

The method of the present invention is performed in a printing press with a cylinder group 11 or 18 by detaching of the driving connection (in operating phase position) between the printing form cylinder 10 and printing form cylinder drive wheel 21 thus to disengage the printing form cylinder 10 from the drive wheel train thus during image formation to drive the printing form cylinder 10 through its dedicated drive 26. During image formation the rotational speed of the printing form cylinder 10, i.e. the imaging speed, is much higher than the maximum printing speed and is suitably 2.5 times as high as the maximum printing speed. As a result of this, the time for image formation is reduced to a minimum and no load is applied to the other parts of the press, because the printing press stands still.

After image formation and shutting down the dedicated drive 26 the printing form cylinder 10 is again attached in its operating phase position to the drive wheel train with the phase position clutch 27. As already mentioned above, the operating phase position is defined by facing of the front lines of printing 29 of the opposite cylinders which are in operating connection. The possibility of printing operation is now resumed.

In another embodiment of the drive of the present invention the dedicated drive 26 is supplied with a current to brake the printing press and to tension the drive wheel train. Thus the existing dedicated drive 26 can also be used to guarantee a pre-tensioning of the drive wheel train during the printing process. The current supplied to the dedicated drive 26 is suitably in the range of 10% of the current used by the main drive motor 12. The current consumption of the main drive motor 12 fluctuates during the printing process and the dedicated drive 26 is supplied with a current to accommodate these fluctuations.

Figure 4:
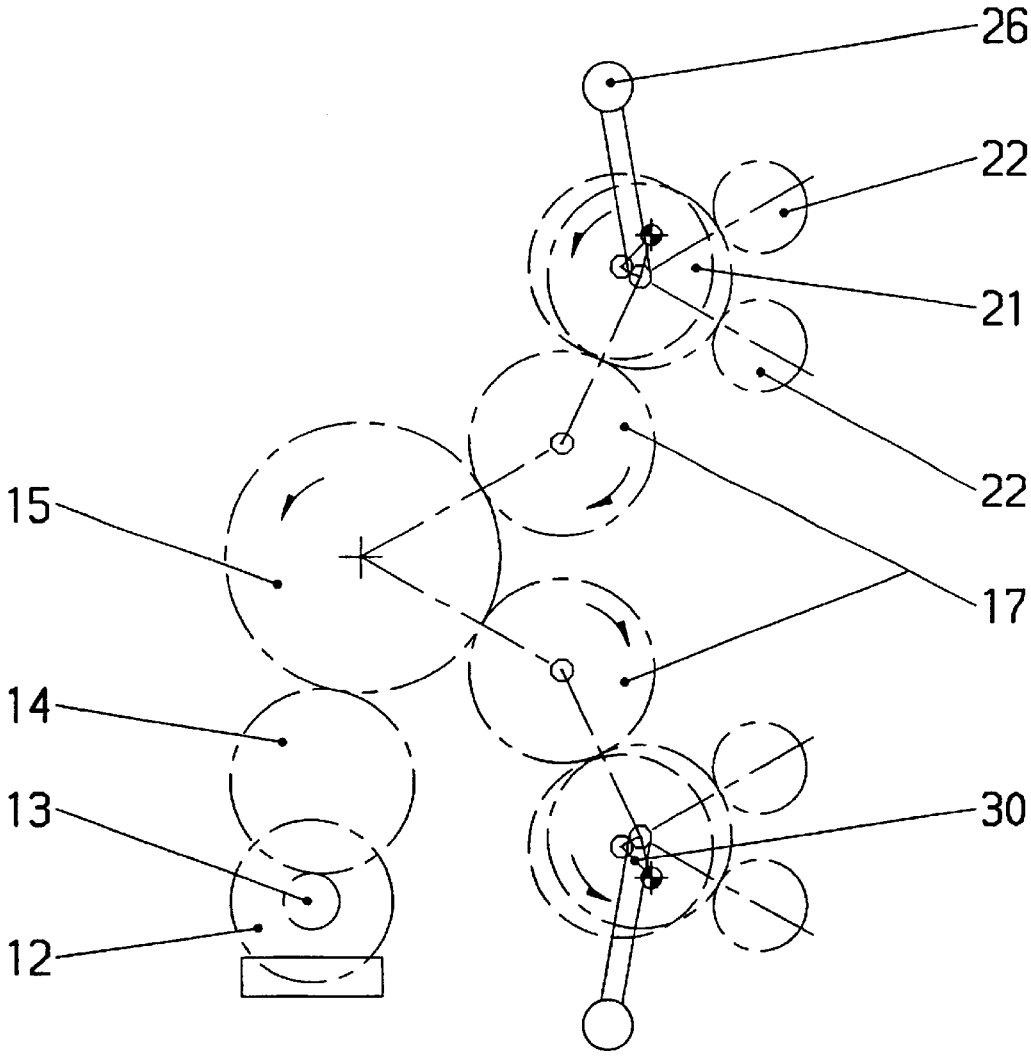
FIG. 4 is an arrangement of an eccentric version of the drive wheel train.
Figure 5:
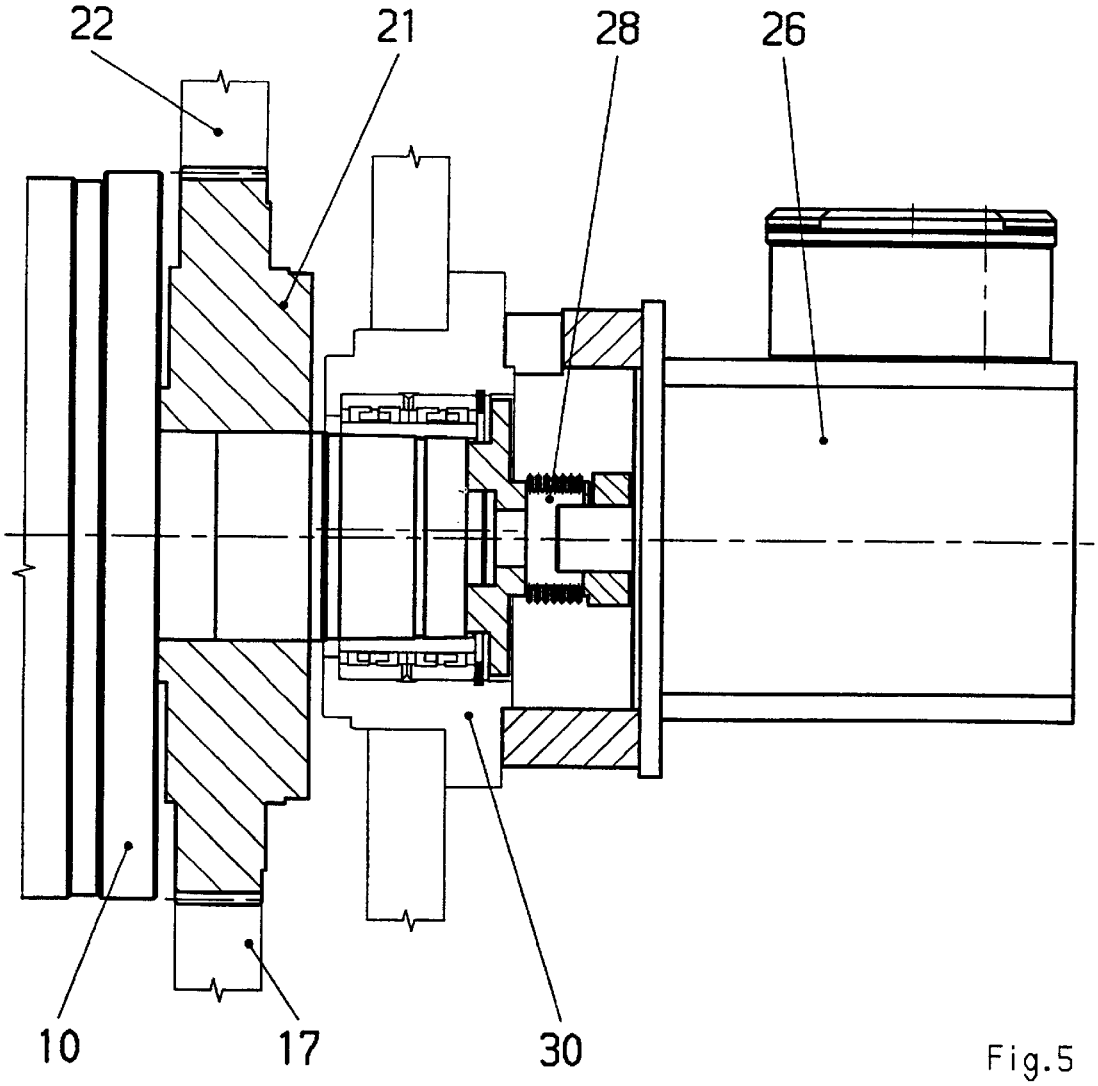
FIG. 5 is an eccentric version of the printing form cylinder.

Alternatively, it is possible to attach and detach the printing form cylinder 10 from the drive system of the printing press with the printing form cylinder drive wheel 21 fixed to the printing form cylinder 10, and the printing form cylinder 10 arranged in eccentric bearings 30, as shown in FIGS. 4 and 5. The drive connection between the printing form cylinder drive wheel 21 and the drive wheel train will then be disengaged by rotating the eccentric bearing 30, so that the printing form cylinder 10 is detached from the drive wheel train and can be driven by its dedicated drive 26 during image formation. The printing form cylinder 10 is engaged in its operating phase position to drive wheel train after image formation and shutting down the dedicated drive 26 by rotating the eccentric bearings 30. The operating phase position is defined by facing of the front lines of printing 29 of the opposite cylinders which are in operating connection. Resumption of the printing operation is now possible.

In the method of the present invention for a printing press with two cylinder groups the drive connections (in the operating phase positions) between the printing form cylinders 10 and the printing form cylinder drive wheels 21 are disengaged by phase position clutches 27 and then the printing form cylinders 10 are detached from the drive wheel train. The printing form cylinders 10 are now driven at imaging speed by their respective dedicated drive 26.

The printing form cylinders 10 are brought from the particular operating phase positions to a phase synchronous position relative to the imaging devices 16 in the catch-up operation during the run-up period of the dedicated drive 26 from standstill to the imaging speed. The phase synchronous position of the printing form cylinder 10 relative to the imaging devices 16 is suitably identical with the front line of printing 29, i.e. both printing form cylinders 10 are facing with their front lines of printing the corresponding imaging device 16. After this synchronization, the printing form cylinders 10 are driven synchronously with imaging speed.

The printing form cylinders 10 are brought back into their particular operating phase positions after the image formation by the following procedure. If the particular printing form cylinder 10 overshoots the operating phase position by the dedicated drive 26, i.e. the dedicated drive 26 is stopped after passing the operating phase position. After that the printing form cylinder 10 is attached to the drive wheel train and mechanical means (phase position clutch) realizes the exact start in the operating phase position during start-up.

In another variant the operating phase position is obtained, with the following process steps. The dedicated drive 26 of the printing form cylinder 10 is stopped before reaching the operating phase position, then the printing form cylinder 10 is attached to the drive wheel train and mechanical means (phase position clutch) is used to realize the exact start in the operating phase position during start-up.

In another embodiment of the drive, after that the dedicated drive is supplied in the described manner by a braking current for the printing press and to tension the drive wheel train.

Figure 6:
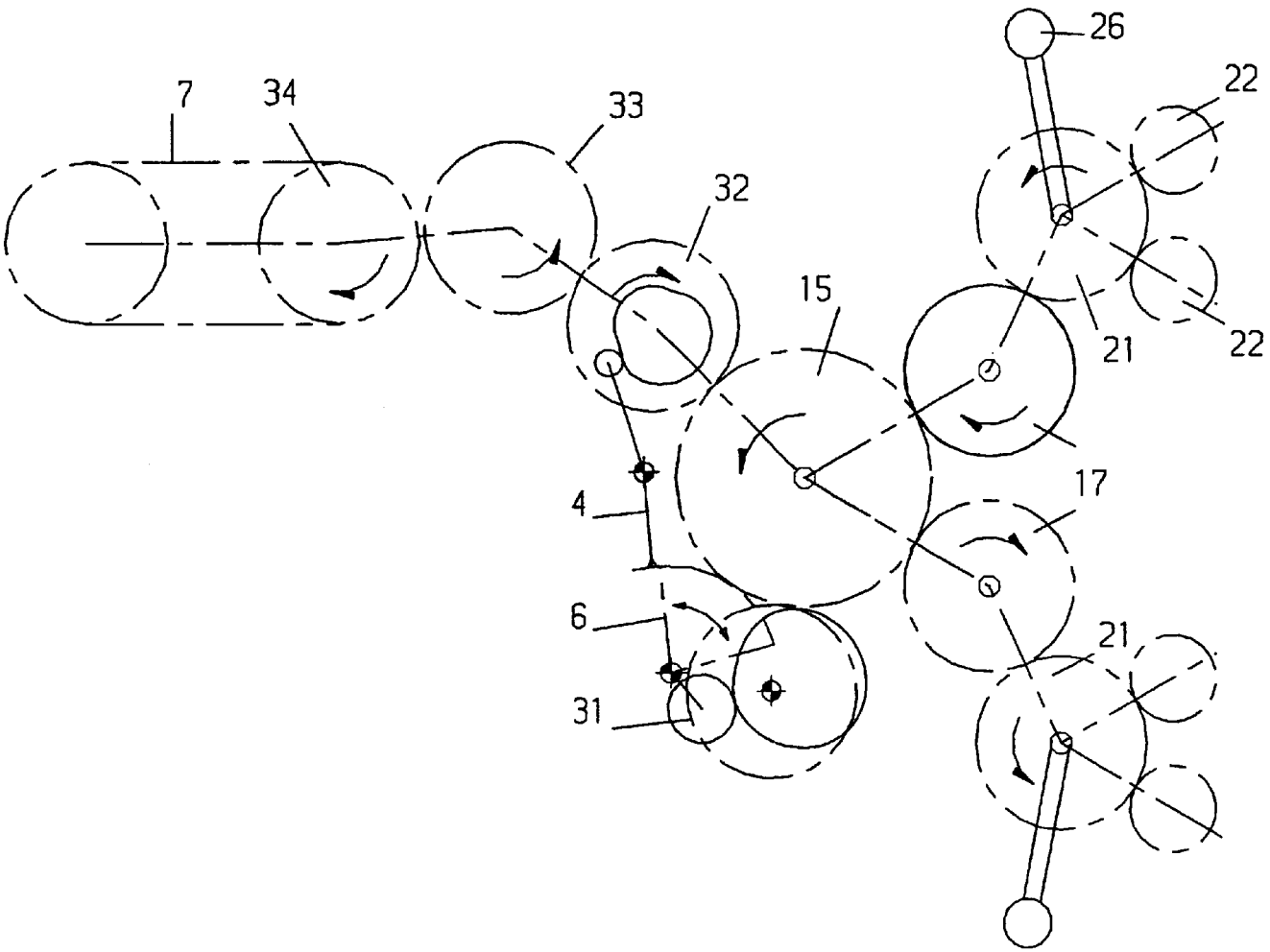
FIG. 6 is a partial drive scheme of a printing press.
Figure 7:
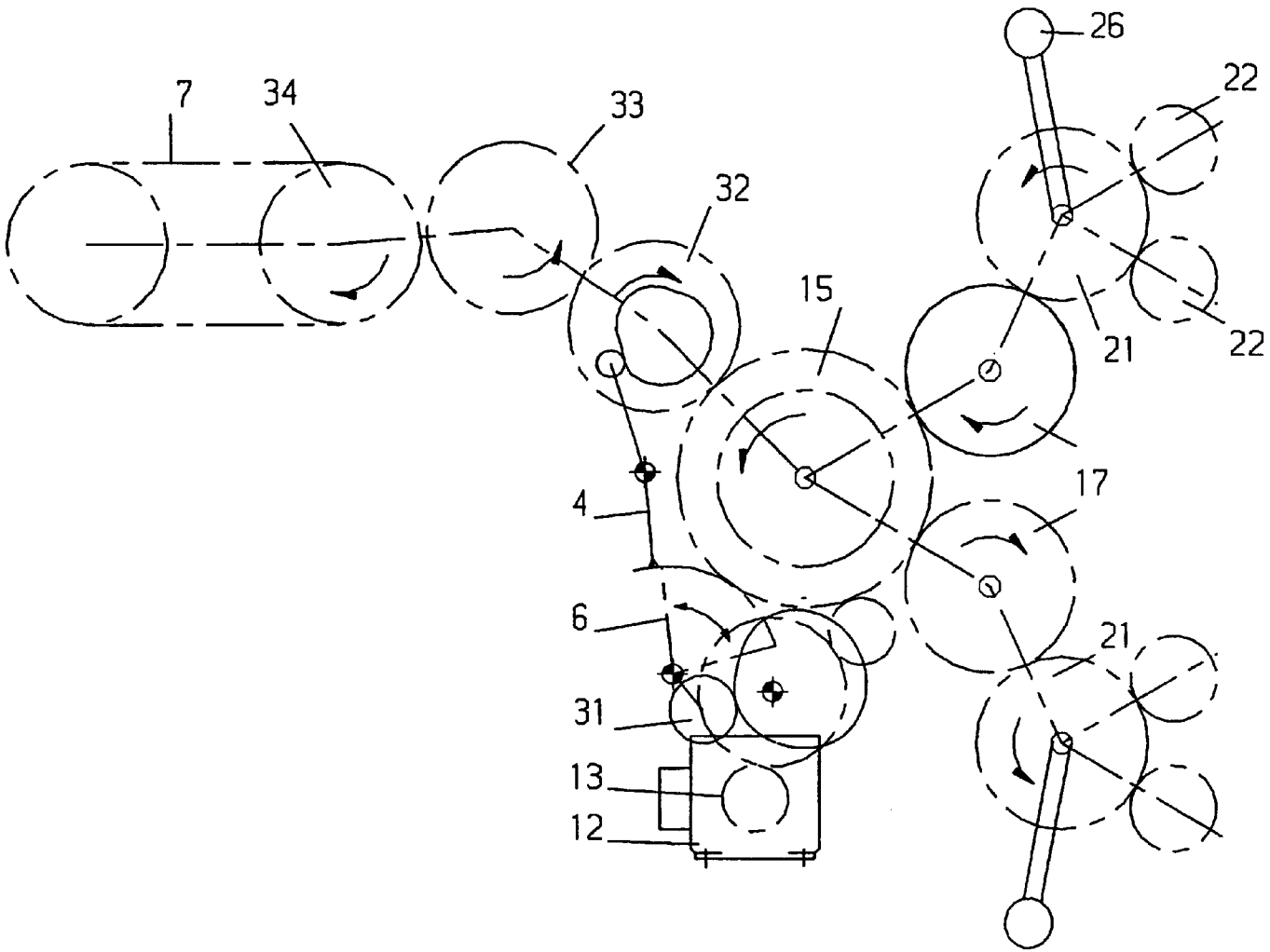
FIG. 7 is a view similar to FIG. 6 showing a motor and pinion drive.

In a further embodiment of the invention the dedicated drive arranged at the printing form cylinder is used partially or totally to drive the printing press during the printing operation. This last embodiment is shown in FIGS. 6 and 7, and is next described by the example of a four-color printing press with two cylinder groups.

As already explained both printing form cylinders 10 with the printing form cylinder drive wheels 21 each have an dedicated drive 26. The drive wheel train of the printing press contains in addition to the printing form cylinder drive wheels 21 two blanket cylinder drive wheels 17, an impression cylinder drive wheel, two form roller drive wheels 22, one gripper system drive wheel 31, one front edge sheet separator drive wheel 32, one intermediate delivery drive wheel 33 and one delivery chain drive wheel 34. The printing form cylinder drive wheels 21 are not actively attached to the drive wheel train during the image formation and the dedicated drive 26 is only driving the printing form cylinders 10. The printing press is at standstill and is not driven.

The inactive engagement of the printing form cylinder drive wheels 21 in the drive wheel train is possible as already explained either by separation of the particular printing form cylinder drive wheels 21 from the printing form cylinder 10 through a clutch or by disengagement of the printing form cylinder drive wheel 21 fixed mounted to the printing form cylinder 10 by swiveling the eccentrically mounted printing form cylinder including the printing form cylinder drive wheel 21. The printing form cylinder drive wheels 21 of this embodiment of the invention are actively attached to the drive wheel train during printing operation and at least one dedicated drive 26 drives the printing press partially or totally.

Dedicated drives must be synchronized if more than one dedicated drives are used to drive the printing press.

In the case of a partial drive of the printing press by a dedicated drive 26 as shown in FIG. 7, only the functional groups with uniform rotating speed are driven by its drive wheels, such as the impression cylinder drive wheel 15, the blanket cylinder drive wheels 17, the printing form cylinder drive wheels 21 and the form roller drive wheels 22.

The nonuniform rotation speed of the gripper system 6, front edge sheet separator 4 and the delivery chain system 7 are driven by the gripper system drive wheel 31, first intermediate wheel 35, second intermediate wheel 36, third intermediate wheel 37, intermediate delivery drive wheel 33 and delivery chain drive wheel 34 from the motor 12. This embodiment is advantageous, because drives that cause vibrations have their own drive gear train.

The motor 12 is synchronized with the dedicated drive or the dedicated drives. Another allocation of the driven functional groups to the motor and the dedicated drive respectively dedicated drives is also possible.

In the method of the present invention for a printing press with one cylinder group the drive connection (in the operating phase position) between the printing form cylinder and the drive wheel train is separated to detach the printing form cylinder from the drive wheel train and to drive the printing form cylinder with the dedicated drive 26 during image formation.

We claim:

1. A method for driving a printing press having (i) an impression cylinder, (ii) at least one cylinder group having (a) a blanket cylinder, (b) a printing form cylinder, and (1) an imaging device, (2) an inking unit, and (3) a dedicated drive system, all for said printing form cylinder, (iii) a sheet feeding device, (iv) a sheet delivering device, (v) a drive wheel train connecting said cylinders and said inking unit, and (vi) a main motor drive, the method comprising detaching the printing form cylinder from said drive wheel train, driving said printing form cylinder by said dedicated drive system at imaging speed during image formation, and re-attaching said printing form cylinder after image formation to said drive wheel train in an operating phase position.

2. The method of claim 1, wherein said cylinder group comprises two cylinder groups, each having (a) a blanket cylinder, (b) a printing form cylinder, and (1) an imaging device, (2) at least one inking unit for each printing form cylinders, and (3) a dedicated drive system, all for said printing form cylinders, the method further comprising detaching one or more of the printing form cylinders from said drive wheel train, driving the detached printing form cylinder by the dedicated drive system allocated to the detached form cylinder, and bringing said form cylinder from its operating phase position to another phase synchronous position relative to its allocated imaging device in a catch-up mode to drive said printing form cylinder at imaging speed during image formation, and re-attaching said printing form cylinder after image formation to said drive wheel train in an operating phase position.

3. The method of claim 1, wherein said imaging speed is faster than the maximum printing speed of the printing press.

4. The method of claim 3, wherein said imaging speed is at least 2.5 times higher than said maximum printing speed.

5. The method of claim 2, wherein a printing form when attached to the printing form cylinder has a front line of printing, and wherein said phase synchronous position of said printing form cylinder relative to the imaging device allocated thereto, is the same as the front line of printing of printing forms attached to the printing form cylinder.

6. The method of claim 1, wherein when the operating phase position of the printing form cylinder is overshot by its allocated dedicated drive system, the dedicated drive system carries out a catch-up mode for the operating phase.

7. The method of claim 1, wherein when the actual operating phase of the printing form cylinder is overshot by its dedicated drive system from its exact operating phase position, mechanically attaining the exact operating phase position of the printing form cylinder after attaching it to the drive wheel train during its start-up.

8. The method of claim 1, further comprising stopping the dedicated drive system before reaching the operating phase position of the printing form cylinder, and mechanically adjusting to the exact operating phase position after attaching the printing from cylinder to the drive wheel train and start-up of the dedicated drive system.

9. The method of claim 1, further comprising braking the printing press.

10. The method of claim 9, wherein said braking comprises supplying current to the dedicated drive system during printing.

11. The method of claim 10, further comprising securing tension of the drive wheel train by supplying current to a dedicated drive system.

12. The method of claim 10, wherein the current for braking is about 10% of the current drawn by said main motor drive.

13. The method of claim 1, which comprises driving said printing press partially with said dedicated drive system.

14. The method of claim 13, wherein said printing press has uniformly rotating functional components, and nonuniformly rotating functional components, further comprising driving said uniformly rotating functional components by the dedicated drive system, and driving the nonuniformly rotating functional components by a drive motor synchronized with the dedicated system.

15. The method of claim 14, wherein said printing press comprises a plurality of synchronized dedicated drive systems.

* * * * *